US006079591A

United States Patent [19]

Timms

[11] Patent Number: 6,079,591

[45] Date of Patent: Jun. 27, 2000

[54] STABLE LIQUID CONTAINER

[76] Inventor: Edward Timms, Rte. 2 Box 104, Leedey, Okla. 73654

[21] Appl. No.: 09/252,112

[22] Filed: Feb. 18, 1999

[51] Int. Cl.[7] ..... B65D 7/00

[52] U.S. Cl. ..... 220/771; 220/592.21; 220/292.2

[58] Field of Search ..... 220/771, 592.2, 220/592.21, 592.23, 592.27, 23.87

[56] References Cited

U.S. PATENT DOCUMENTS

| | | | |
|---|---|---|---|
| 1,540,311 | 6/1925 | Brainard | 220/592.2 X |
| 1,625,183 | 4/1927 | Abbott | 220/592.21 X |
| 1,877,290 | 9/1932 | Forrest | 220/592.2 X |
| 2,564,843 | 8/1951 | Hemp | 220/592.2 X |
| 3,744,622 | 7/1973 | Weaver | 220/592.2 X |
| 4,071,160 | 1/1978 | Vick | 220/592.2 |
| 5,168,793 | 12/1992 | Padamsee | 220/592.21 X |

*Primary Examiner*—Steven Pollard

[57] ABSTRACT

A stable container system is provided including a container having an outer shell with a bottom face, a side wall integrally coupled to the bottom face and extending upwardly therefrom in perpendicular relationship therewith, and a top face for defining an interior space. The container further includes an inner shell with a width which tapers from bottom to top. The inner shell is positioned within the outer shell. Also included is a cap for selectively sealing the inner shell.

11 Claims, 2 Drawing Sheets

STABLE LIQUID CONTAINER

BACKGROUND OF THE INVENTION

1. Field of the Invention

The present invention relates to liquid storage containers and more particularly pertains to a new stable liquid container for storing liquid in a stable manner.

2. Description of the Prior Art

The use of liquid storage containers is known in the prior art. More specifically, liquid storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,217,141; U.S. Pat. No. 5,515,995; U.S. Pat. No. 2,143,027, U.S. Pat. No. 5,102,000; U.S. Pat. No. 2,810,491; and U.S. Pat. No. Des. 353,772.

In these respects, the stable liquid container according to tile present invention substantially departs from the conventional concepts and designs of the prior art, and in so doing provides an apparatus primarily developed for the purpose of storing liquid in a stable manner.

SUMMARY OF THE INVENTION

In view of the foregoing disadvantages inherent in the known types of liquid storage containers now present in the prior art, the present invention provides a new stable liquid container construction wherein the same can be utilized for storing liquid in a stable manner.

The general purpose of the present invention, which will be described subsequently in greater detail, is to provide a new stable liquid container apparatus and method which has many of the advantages of the liquid storage containers mentioned heretofore and many novel features that result in a new stable liquid container which is not anticipated, rendered obvious, suggested, or even implied by any of the prior art liquid storage containers, either alone or in any combination thereof.

To attain this, the present invention generally comprises a container having an outer shell including a substantially planar circular bottom face, a substantially cylindrical side wall, and a substantially planar circular top face for defining an interior space. For stability purposes, the top face and the bottom face of the outer shell each have a diameter equal to a height of the side wall of the outer shell. Further, the top face of the outer shell has a circular bore formed therein with a diameter of at least 5 inches. Such dimensions are critical for facilitate cleaning of the container. As shown in FIG. 4, the container further includes an inner shell including a substantially planar circular bottom face and a side wall integrally coupled to the bottom face of the inner shell and extending upwardly therefrom. The inner shell includes a lower portion with a substantially cylindrical configuration having a height equal to about ⅕ that of the side wall of the outer shell. Associated therewith is an upper portion with a substantially frusto-conical configuration and a substantially cylindrical upper sleeve. The upper sleeve is equipped with an open top integrally coupled to a lower surface of the top face of the outer shell about a periphery of the bore. The upper sleeve has a plurality of interior threaded grooves formed therein. In use, the inner shell is positioned within the outer shell with an insulation material positioned therebetween. Also included is a handle including a vertically oriented substantially oval indentation formed in the side wall of the outer shell adjacent the top face thereof. Mounted between ends of the oval indentation is a vertically oriented rod which remains flush with the side wall of the outer shell for defining a handle. Next provided is a spout assembly including a substantially rectangular indentation formed in the side wall of the outer shell adjacent to the bottom face. A spout is mounted within the rectangular indentation and remains in communication with the inner shell with a pair of diametrically opposed gripping cars and a dispensing push button. Such dispensing push button is positioned inwardly of the side wall of the outer shell for dispensing liquid from the container upon the depression thereof. Also included is a cap having a substantially planar circular bottom face, a cylindrical side wall, and a planar circular top face for defining an interior space. The top face and the bottom face of the cap each have a diameter equal to that of the container. Further, the bottom face has a hollow substantially cylindrical protrusion coupled thereto and extending downwardly therefrom with a plurality of threaded grooves formed therein. Such protrusion is adapted for releasably engaging the threaded grooves of the inner shell of the container. As shown in FIG. 1, the top face of the cap further includes a plurality of substantially square gripping indentations. Also shown is a horizontally oriented substantially oval indentation. A horizontally oriented rod is mounted between ends of the oval indentation of the cap and remains flush with the top face of the cap for defining a handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stable liquid container apparatus and method which has many of the advantages of the liquid storage containers mentioned heretofore and many novel features that result in a new stable liquid container which is not anticipated, rendered obvious, suggested, or even implied by any of the prior art liquid storage containers, either alone or in any combination thereof.

It is another object of the present invention to provide a new stable liquid container which may be easily and efficiently manufactured and marketed.

It is a further object of the present invention to provide a new stable liquid container which is of a durable and reliable construction.

An even further object of the present invention is to provide a new stable liquid container which is susceptible of a low cost of manufacture with regard to both materials and labor, and which accordingly is then susceptible of low prices of sale to the consuming public, thereby making such stable liquid container economically available to the buying public.

Still yet another object of the present invention is to provide a new stable liquid container which provides in the apparatuses and methods of the prior art some of the advantages thereof, while simultaneously overcoming some of the disadvantages normally associated therewith.

Still another object of the present invention is to provide a new stable liquid container for storing liquid in a stable manner.

Even still another object of the present invention is to provide a new stable liquid container that includes a container having an outer shell with a bottom face, a side wall integrally coupled to the bottom face and extending upwardly therefrom in perpendicular relationship therewith, and a top face for defining an interior space. The container further includes an inner shell with a width which tapers from bottom to top. The inner shell is positioned within the outer shell. Also included is a cap for selectively sealing the inner shell.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
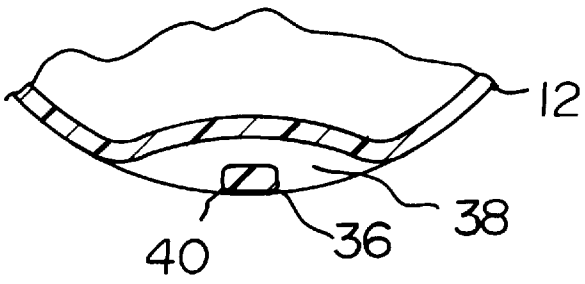
FIG. 2 is a side cross-sectional view of a handle of the present invention.

With reference now to the drawings, and in particular to FIGS. 1 through 4 thereof, a new stable liquid container embodying the principles and concepts of the present invention and generally designated by the reference numeral 10 will be described.

The present invention, designated as numeral 10, includes a container 12 having an outer shell 14 including a substantially planar circular bottom face 16, a substantially cylindrical side wall 18, and a substantially planar circular top face 20 for defining an interior space. Ideally, the side wall meets the bottom face at a sharp right angle. For stability purposes, the top face and the bottom face of the outer shell each have a diameter equal to a height of the side wall of the outer shell. Both the height and width are preferably 13 inches. Further, the top face of the outer shell has a circular bore 22 formed therein with a diameter of at least 5 inches. Such dimension is critical for facilitate cleaning of the container.

Figure 4:
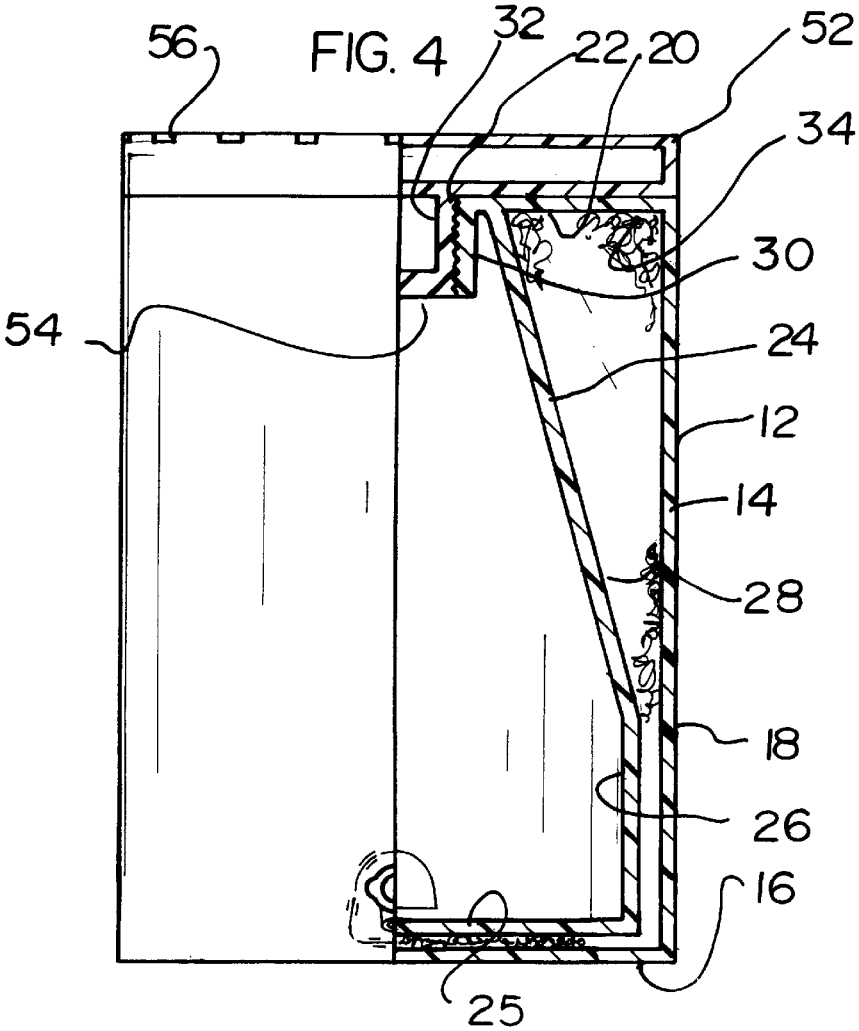
FIG. 4 is a side cross-sectional view of the present invention.

As shown in FIG. 4, the container further includes an inner shell 24 including a substantially planar circular bottom face 25 and a side wall integrally coupled to the bottom face of the inner shell and extending upwardly therefrom. The inner shell includes a lower portion 26 with a substantially cylindrical configuration having a height equal to about ⅕ that of the side wall of the outer shell. Associated therewith is an upper portion 28 with a substantially frustoconical configuration and a substantially cylindrical upper sleeve 30. The upper sleeve is equipped with an open top integrally coupled to a lower surface of the top face of the outer shell about a periphery of the bore. The upper sleeve has a plurality of interior threaded grooves 32 formed therein. In use, the inner shell is positioned within the outer shell with an insulation material 34 positioned therebetween.

Also included is a handle 36 including a vertically oriented substantially oval indentation 38 formed in the side wall of the outer shell adjacent the top face thereof. Mounted between ends of the oval indentation is a vertically oriented rod 40 which remains flush with the side wall of the outer shell for defining a handle.

Next provided is a spout assembly 42 including a substantially rectangular indentation 44 formed in the side wall of the outer shell adjacent to the bottom face. A spout 46 is mounted within the rectangular indentation and remains in communication with the inner shell with a pair of diametrically opposed gripping cars 48 and a dispensing push button 50. Such dispensing push button is positioned inwardly of the side wall of the outer shell for dispensing liquid from the container upon the depression thereof.

Also included is a cap 52 having a substantially planar circular bottom face, a cylindrical side wall, and a planar circular top face for defining an interior space. The top face and the bottom face of the cap each have a diameter equal to that of the container. Further, the bottom face has a hollow substantially cylindrical protrusion 54 coupled thereto and extending downwardly therefrom with a plurality of threaded grooves formed therein. Such protrusion is adapted for releasably engaging the threaded grooves of the inner shell of the container.

Figure 1:
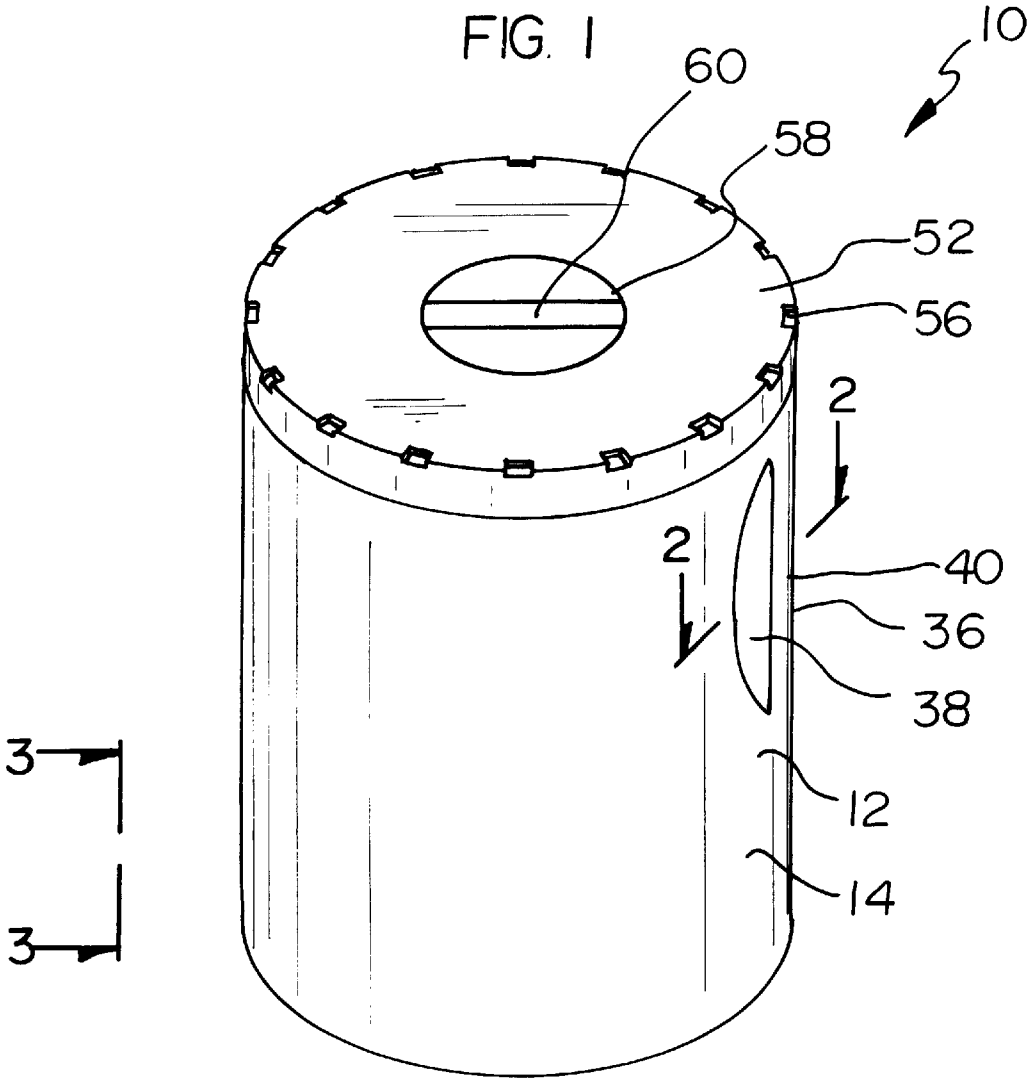
FIG. 1 is a perspective view of a new stable liquid container according to the present invention.
Figure 3:
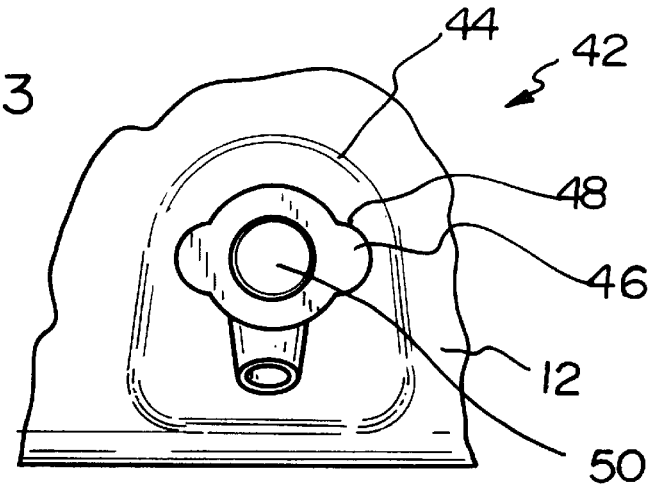
FIG. 3 is a side view of a spout of the present invention.

As shown in FIG. 1, the top face of the cap further includes a plurality of substantially square gripping indentations 56. Also shown is a horizontally oriented, substantially oval indentation 58. A horizontally oriented rod 60 is mounted between ends of the oval indentation of the cap and remains flush with the top face of the cap for defining a handle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stable container system comprising, in combination:

a container including an outer shell including a substantially planar circular bottom face, a substantially cylindrical side wall integrally coupled to the bottom face and extending upwardly therefrom, and a substantially planar circular top face for defining an interior space, the top face and the bottom face of the outer shell each having a diameter equal to a height of the side wall of the outer shell, the top face of the outer shell having a circular bore formed therein with a diameter of at least 5 inches, the container further including an inner shell including a substantially planar circular bottom face, a side wall integrally coupled to the bottom face of the inner shell and extending upwardly therefrom and including a lower portion with a substantially cylindrical configuration having a height equal to about ⅕ that of the side wall of the outer shell and an upper portion with a substantially frusto-conical configuration and a substantially cylindrical upper sleeve with an open top integrally coupled to a lower surface of the top face of the outer shell about a periphery of the bore and having a plurality of interior threaded grooves formed therein, wherein the inner shell is positioned within the outer shell with an insulation material positioned therebetween;

said container further including a vertically oriented substantially oval indentation formed in the side wall of the outer shell adjacent the top face thereof and a vertically oriented rod mounted between ends of the oval indentation and flush with the side wall of the outer shell for defining a handle;

said container further including a substantially rectangular indentation formed in the side wall of the outer shell adjacent to the bottom face and a spout mounted within the rectangular indentation and in communication with the inner shell with a pair of diametrically opposed gripping ears and a dispensing push button positioned inwardly of the side wall of the outer shell for dispensing liquid from the container upon the depression thereof; and a cap including a substantially planar circular bottom face, a cylindrical side wall integrally coupled to the bottom face and extending upwardly therefrom, and a planar circular top face for defining an interior space, wherein the top face and the bottom face of the cap each have a diameter equal to that of the container, the bottom face having a hollow substantially cylindrical protrusion coupled thereto and extending downwardly therefrom with a plurality of threaded grooves formed therein for releasably engaging the threaded grooves of the inner shell of the container, the top face of the cap further including a plurality of substantially square gripping indentations and a horizontally oriented substantially oval indentation formed in the top face of the cap and a horizontally oriented rod mounted between ends of the oval indentation of the cap and flush with the top face of the cap for defining a handle.

2. A stable container system comprising:

a container including an outer shell with a bottom face, a side wall integrally coupled to the bottom face and extending upwardly therefrom in perpendicular relationship therewith, and a top face for defining an interior space, the side wall being cylindrical and having a uniform diameter from the top face to the bottom face, the container further including an inner shell positioned within the outer shell, the inner shell having a circular cross section and a diameter that tapers smaller from bottom to top; and a cap for selectively sealing the inner shell.

3. A stable container system as set forth in claim 2 wherein the inner shell is positioned within the outer shell with an insulation material positioned therebetween, wherein a thickness of the insulation material is greater near the top face than near the bottom face.

4. A stable container system as set forth in claim 2 wherein the outer shell has a substantially cylindrical configuration and the inner shell includes a lower portion with a substantially cylindrical configuration and an upper portion with a substantially frusto-conical configuration.

5. A stable container system as set forth in claim 4 wherein the lower portion has a height which is no greater than ⅕ a height of the container.

6. A stable container system as set forth in claim 2 wherein the container has an indentation formed therein adjacent to the bottom face of the outer shell with a spout mounted therein and inset with respect to the side wall of the outer shell of the container.

7. A stable container system as set forth in claim 2 wherein the container has an opening with a width of at least 5 inches.

8. A stable container system as set forth in claim 2 wherein the container has a width which is equal to a height thereof.

9. A stable container system as set forth in claim 2 wherein said container includes an indentation formed in the side wall of the outer shell in an upper half of the side wall, and a handle rod extending between ends of the indentation, the handle rod extending flush with the side wall of the outer shell such that a hand of a user may be inserted between the handle rod and the indentation for gripping the handle rod.

10. A stable container system as set forth in claim 2 wherein the cap has an outer diameter equal to the side wall of the outer shell.

11. A stable container system comprising:

a container including an outer shell including a bottom face, a side wall integrally coupled to the bottom face and extending upwardly therefrom, and a top face for defining an interior space, the top face and the bottom face of the outer shell each having a substantially equal diameter, the container further including an inner shell including a bottom face, a side wall integrally coupled to the bottom face of the inner shell and extending upwardly therefrom and including a lower portion and an upper portion with a substantially frusto-conical configuration and an upper sleeve with an open top integrally coupled to a lower surface of the top face of the outer shell about a periphery of the bore and having a plurality of interior threaded grooves formed therein, wherein the inner shell is positioned in the outer shell with an insulation material positioned therebetween;

said container further including a vertically oriented substantially oval indentation formed in the side wall of the outer shell adjacent the top face thereof and a vertically oriented rod mounted between ends of the oval indentation and flush with the side wall of the outer shell for defining a handle;

said container further including a substantially rectangular indentation formed in the side wall of the outer shell adjacent to the bottom face and a spout mounted within the rectangular indentation and in communication with the inner shell with a pair of diametrically opposed gripping ears and a dispensing push button positioned inwardly of the side wall of the outer shell for dispensing liquid from the container upon the depression thereof; and a cap including a bottom face, a side wall integrally coupled to the bottom face and extending upwardly therefrom, and a top face for defining an interior space, wherein the top face and the bottom face of the cap each have a diameter equal to that of the container, the bottom face having a substantially hollow protrusion formed thereon and extending downwardly therefrom with a plurality of threaded grooves formed therein for releasably engaging the threaded grooves of the inner shell of the container, the top face of the cap further including a plurality of gripping indentations and a substantially oval indentation formed in the top face of the cap and a rod mounted between ends of the oval indentation of the cap and flush with the top face of the cap for defining a handle.

* * * * *